US010060626B2

(12) United States Patent
Heinze et al.

(10) Patent No.: US 10,060,626 B2
(45) Date of Patent: Aug. 28, 2018

(54) GAS TURBINE COMBUSTION CHAMBER WITH A SHINGLE ATTACHMENT BY MEANS OF CATCHING ELEMENTS

(71) Applicant: Rolls Royce Deutschland Ltd & Co KG, Blankenfelde-Mahlow (DE)

(72) Inventors: Kay Heinze, Ludwigsfelde (DE); Stefan Penz, Werneuchen (DE); Ivo Szarvasy, Stahnsdorf (DE)

(73) Assignee: ROLLS-ROYCE DEUTSCHLAND LTD & CO KG, Blankenfelde-Mahlow (DE)

( * ) Notice: Subject to any disclaimer, the term of this patent is extended or adjusted under 35 U.S.C. 154(b) by 0 days.

(21) Appl. No.: 15/377,154

(22) Filed: Dec. 13, 2016

(65) Prior Publication Data

US 2017/0167730 A1 Jun. 15, 2017

(30) Foreign Application Priority Data

Dec. 14, 2015 (DE) ..... 10 2015 225 107

(51) Int. Cl.
*F23R 3/16* (2006.01)
*F23R 3/00* (2006.01)

(52) U.S. Cl.
CPC ..... *F23R 3/16* (2013.01); *F23R 3/002* (2013.01); *F23R 2900/00017* (2013.01)

(58) Field of Classification Search
CPC .. F23R 3/16; F23R 3/002; F23R 2900/00017; Y10T 403/32434
See application file for complete search history.

(56) References Cited

U.S. PATENT DOCUMENTS 4,820,097 A 4/1989 Maeda et al.
4,848,089 A 7/1989 Cramer
(Continued)

FOREIGN PATENT DOCUMENTS

DE 2012949 A1 10/1970
DE 69515055 T2 9/2000
(Continued)

OTHER PUBLICATIONS

German Search Report dated Oct. 7, 2016 for counterpart German Application No. DE 10 2015 225 107.1.
(Continued)

*Primary Examiner* — Todd E Manahan
*Assistant Examiner* — Stefan Ibroni
(74) *Attorney, Agent, or Firm* — Shuttleworth & Ingersoll, PLC; Timothy J. Klima

(57) ABSTRACT

A gas turbine combustion chamber with a combustion chamber wall and with at least one shingle that is fastened to the combustion chamber wall at a distance from the same, wherein the shingle has a shingle edge that abuts the combustion chamber wall, wherein the combustion chamber wall and the combustion chamber shingle respectively have at least one mixed air hole, and wherein a tubular fastening element provided with a ring flange is inserted through the mixed air hole of the combustion chamber wall, abutting the side of the combustion chamber wall that is facing away from the combustion chamber shingle with the ring flange, characterized in that, at its exterior side, the fastening element is provided with first snap-in means that are in mesh with second snap-in means that are formed at a tubular snap-in element that braces the combustion chamber shingle against the combustion chamber wall.

6 Claims, 5 Drawing Sheets

(56) References Cited

U.S. PATENT DOCUMENTS

Figure 1:
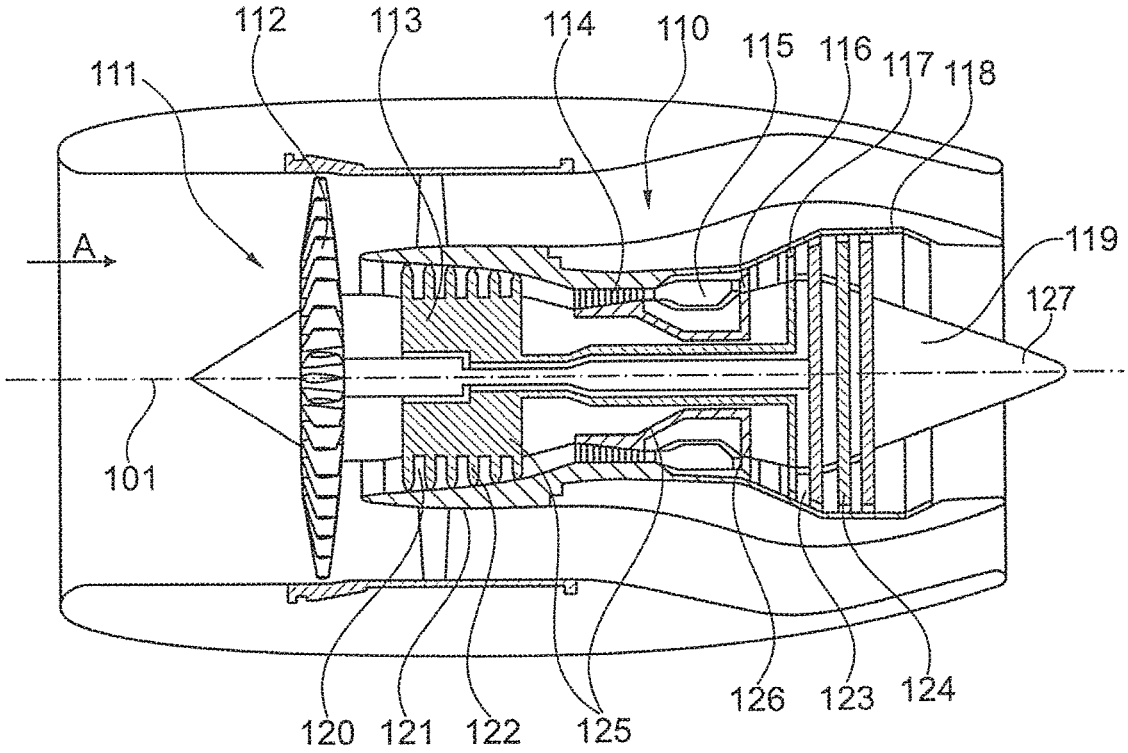

| | | | | |
|---|---|---|---|---|
| 5,201,799 | A | 4/1993 | Johnson | |
| 5,501,071 | A | 3/1996 | Ansart et al. | |
| 5,897,277 | A | 4/1999 | Barre et al. | |
| 6,938,424 | B2 | 9/2005 | Tiemann | |
| 8,943,656 | B2 | 2/2015 | Bishop | |
| 9,341,372 | B2 | 5/2016 | Penz | |
| 2014/0144146 | A1* | 5/2014 | Penz | F23R 3/007 60/753 |
| 2015/0010372 | A1 | 1/2015 | Herrema | |
| 2015/0128602 | A1 | 5/2015 | Clemen | |

FOREIGN PATENT DOCUMENTS

| | | | |
|---|---|---|---|
| DE | 60221743 | T2 | 6/2008 |
| EP | 1213489 | A1 | 6/2002 |
| EP | 1413831 | A1 | 4/2004 |
| EP | 1635118 | A2 | 3/2006 |
| EP | 2295865 | A2 | 3/2011 |
| EP | 2700877 | A2 | 2/2014 |
| EP | 2738470 | A1 | 6/2014 |
| EP | 2743585 | A1 | 6/2014 |
| EP | 2873921 | A1 | 5/2015 |
| EP | 2886962 | A1 | 6/2015 |
| WO | WO2015005980 | A1 | 1/2015 |

OTHER PUBLICATIONS

European Search Report dated May 8, 2017 from counterpart European App No. 16202396.4.

European Exam Report dated Oct. 6, 2017 from counterpart EP App No. 16202396.4.

* cited by examiner

GAS TURBINE COMBUSTION CHAMBER WITH A SHINGLE ATTACHMENT BY MEANS OF CATCHING ELEMENTS

This application claims priority to German Patent Application DE102015225107.1 filed Dec. 14, 2015, the entirety of which is incorporated by reference herein.

The invention relates to a gas turbine combustion chamber.

Specifically, the invention relates to a gas turbine combustion chamber with a combustion chamber wall and with at least one shingle that is attached to the combustion chamber wall at a distance from the same. What is thus present is a double-walled combustion chamber construction in which the outer combustion chamber wall serves as a shingle support. A cooling air flow passes through the clearance between the shingle and the combustion chamber wall. In addition, at least one mixed air hole is provided, penetrating the combustion chamber wall as well as the shingle, so that mixed air can be guided into the interior space of the combustion chamber.

At its circumferential edge, the shingle has a shingle edge that abuts the outer combustion chamber wall. The shingle edge particularly serves the purpose of maintaining the distance between the combustion chamber wall and the shingle, and thus of ensuring an effective cooling.

A tubular fastening element which is provided with a ring flange is inserted through the mixed air hole of the combustion chamber wall, abutting that side of the combustion chamber wall that is facing away from the shingle, i.e. the cold side of the combustion chamber wall, with the ring flange. Such a construction is known from EP 2 738 470 B1.

The state of the art shows a variety of possibilities for attaching the shingle at the combustion chamber wall:

EP 1 413 831 A1 and EP 2 886 962 A1 show constructions in which hook elements are provided for fixating the shingles.

Already known from EP 2 873 921 A1 is a construction in which a stud bolt is connected to an element that is bonded to the cold side of the combustion chamber shingle. The stud bolt extends through the combustion chamber wall and is screwed on at the exterior side of the combustion chamber wall. A screw connection by means of a bolt that is mounted from the exterior side of the combustion chamber wall is also shown in EP 2 295 865 A2. A screw connection realized by means of a bolt that is configured in one piece with the shingle is already known from EP 2 743 585 A1. A modified construction, in which the base area of the bolt is cooled by means of impingement cooling, is shown in EP 2 700 877 A2.

In the abovementioned EP 2 738 470 B1, a screw connection of a fastening element forming a mixed air hole to a flange-like projection of the shingle is provided. Here, there may be the disadvantage that the screw connection needs to be additionally secured against any loosening. Moreover, in this construction only circular mixed air holes can be formed.

In general, with double-walled combustion chambers there is always the necessity to attach the combustion chamber shingles at the combustion chamber wall in a reliable manner. The combustion chamber shingles protect the combustion chamber housing from the high temperatures that occur inside the combustion chamber during the combustion. In order to achieve a sufficiently long service life of the individual shingles, they are provided with a protective ceramic layer at the hot-gas side. In addition, the shingles have effusion cooling holes through which cooling air can exit from the intermediate space between the combustion chamber wall and the shingle and settle on the hot side of the shingle as a cooling film. Cooling of the shingle through the effusion cooling holes is an important aspect when it comes to ensuring a steady shingle temperature. When the shingles are attached by means of conventional fastening elements, for example screws, there is the disadvantage that it is not possible to provide sufficient cooling of the combustion chamber shingles in the fastening area of the screws, since no effusion cooling holes can be provided there without compromising the mechanical characteristic of the fastening element. In this way, an ineffective cooling of the hot side of the shingles results in these areas. This in turn leads to higher local temperatures which has a negative impact on the service life of the fastening elements as well as on the service life of the shingle itself.

The invention is based on the objective to create a combustion chamber with a shingle fastening in which the disadvantages of the state of the art are avoided and in particular a good cooling of the combustion chamber shingle is facilitated, while at the same time having a simple structure and being easy and cost-effective to manufacture.

The objective is achieved by a combination of features disclosed herein, with the present disclosure showing further advantageous embodiments.

Thus, it is provided according to the invention that, at its exterior side, the fastening element is provided with first snap-in means which are in mesh with second snap-in means that are formed at a tubular snap-in element that braces the combustion chamber shingle against the combustion chamber wall.

Thus, the solution according to the invention provides a snap-in effect by means of the fastening element. This snap-in effect is effected by bracing the combustion chamber shingle against the combustion chamber wall by applying a pre-stress. Thus, according to the invention, no screws or threaded bolts or the like are necessary. Consequently, no additional structural components need to be provided at the shingle itself. In this manner, the overall structure of the shingle is considerably simplified. Besides, the shingle can have a constant wall thickness which results in optimized cooling characteristics. Since no screw connection is present according to the invention, there is also no danger of the shingle disengaging from the combustion chamber, for example due to vibrations that occur during the operation of the gas turbine.

According to the invention, it is also not necessary to insert additional holes into the outer, cold combustion chamber wall for the purpose of fastening by means of threaded bolts, or the like. These may have a negative effect on the strength of the overall construction and lead to an increased manufacturing effort. Instead, according to the invention, the existing mixed air holes or mixed air openings are used to insert respectively one fastening element into these mixed air openings, with the fastening element being configured in a tubular manner and extends in the direction towards the combustion chamber shingle or through the same and is used for snap-in with the combustion chamber shingle. What is thus achieved is a self-retaining snap-in effect of the combustion chamber shingle.

In an advantageous design of the invention it can be provided that the snap-in part is configured in one piece with the combustion chamber shingle. But it is also possible to manufacture the snap-in element as a separate structural component and to insert it into the mixed air hole of the combustion chamber shingle during mounting. The first design variant is especially advantageous with combustion chamber shingles that are manufactured by means of a casting method or by means of an additive method, such as for example a laser deposition welding method. In this way, the snap-in element can be manufactured in one piece with the shingle in a simple as well as cost effective manner. If the snap-in element is designed as a separate piece, particularly shingles that are made of a sheet metal material can be fastened at the combustion chamber wall in a secure and reliable manner.

According to the invention, the snap-in element is preferably configured in a tubular manner and has the second snap-in means at its internal side. According to the invention, the first and/or the second snap-in means can be configured in the form of ring-like elevations and/or grooves. However, it is also possible to provide individual snap-in hooks or the like, which mesh into ring-like grooves or recesses of the respectively corresponding structural component.

In order to anchor the snap-in element with the fastening element by means of a snap-in connection, it is particularly advantageous if either the snap-in element or the fastening element is configured so as to be elastic in the area of the snap-in means. This can for example be realized through at least one longitudinal slit that extends along the central axis of the mixed air hole. Here, it is particularly advantageous if the snap-in element provided at the combustion chamber shingle is configured so as to be rigid, while the fastening element is at least partially elastic, for example as a result of the slit described above.

According to the invention, the mounting of the combustion chamber shingle can be effected by manually pressing together and sapping in the fastening element with the snap-in element. By using suitable tools, it is possible to remove the combustion chamber shingle again, for example for repair or maintenance purposes.

A considerable advantage of the present invention is the fact that the mixed air hole does not have to be designed to be circular. Rather, it is also possible to provide elongated or oval mixed air holes, and to correspondingly adjust the fastening elements and the snap-in elements to the shape of the respective mixed air hole.

In an advantageous further development, the solution according to the invention facilitates the mounting of the combustion chamber shingle at the combustion chamber wall, without the combustion chamber shingle having any direct contact at the combustion chamber wall in the area of the mixed air holes. Instead, the combustion chamber shingle abuts the combustion chamber wall with its shingle edges so as to ensure that there is sufficient intermediate space for cooling air to be introduced. In the area of the mixed air holes, mounting may be carried out in a manner according to the invention by obtaining pre-stressing between the shingle and the combustion chamber wall. The degree of pre-stressing can be chosen according to construction, for example based on the height of the shingle edge and/or the dimensioning of the fastening element and of the tubular snap-in element. Through the pre-stressing, the mounting of the combustion chamber shingle is ensured.

Figure 2:
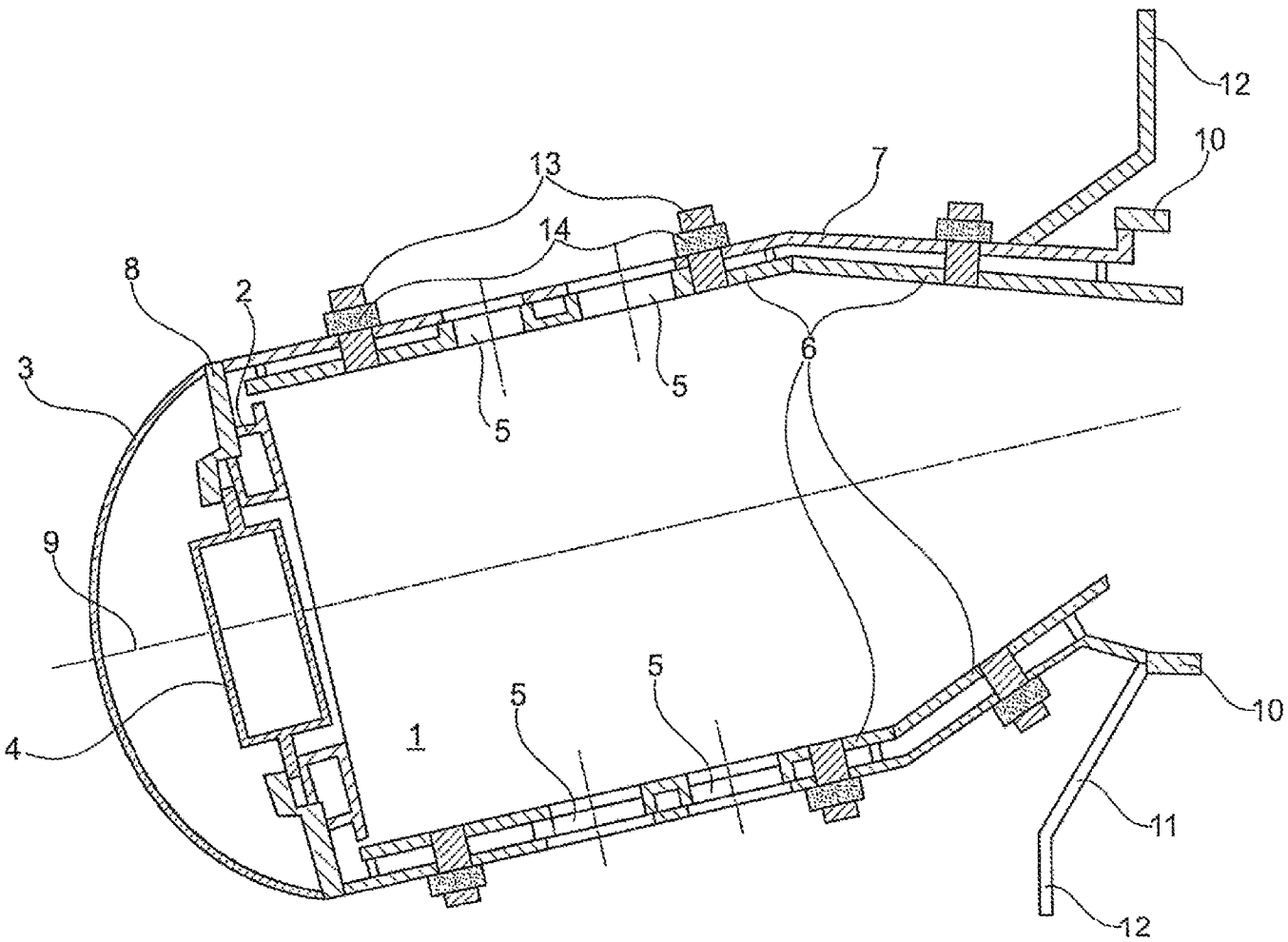
Figure 3:
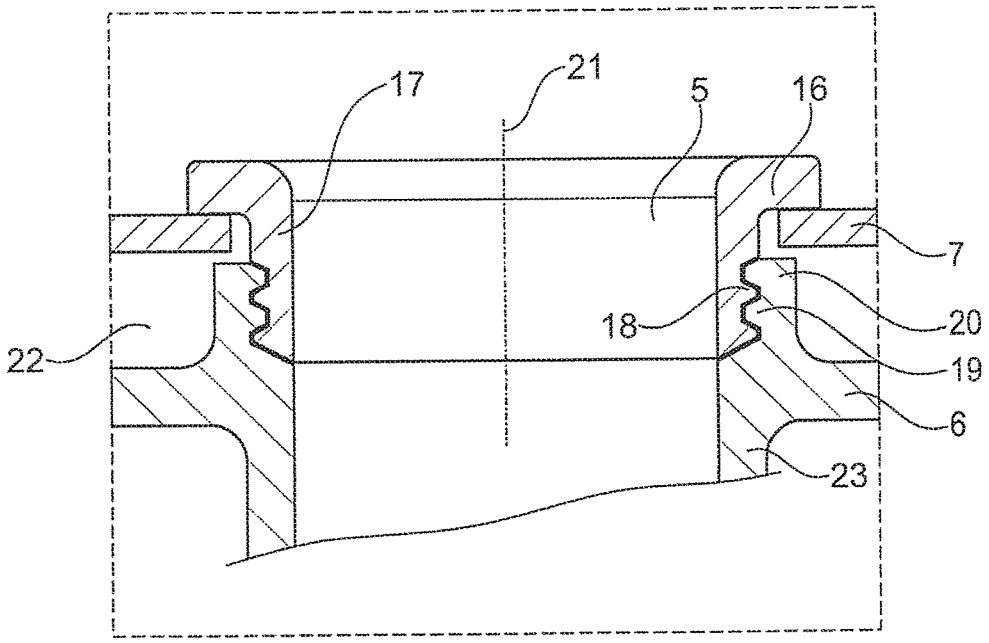
Figures 4, 5:
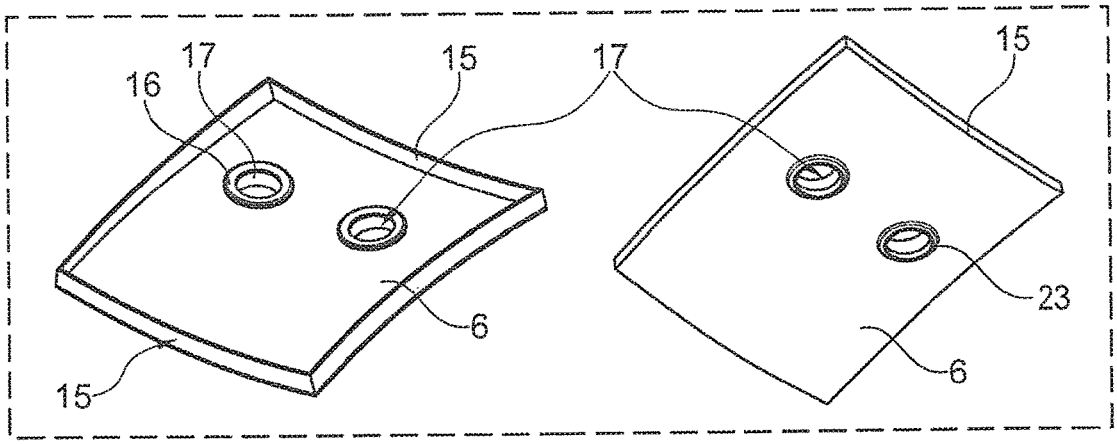
Figure 6:
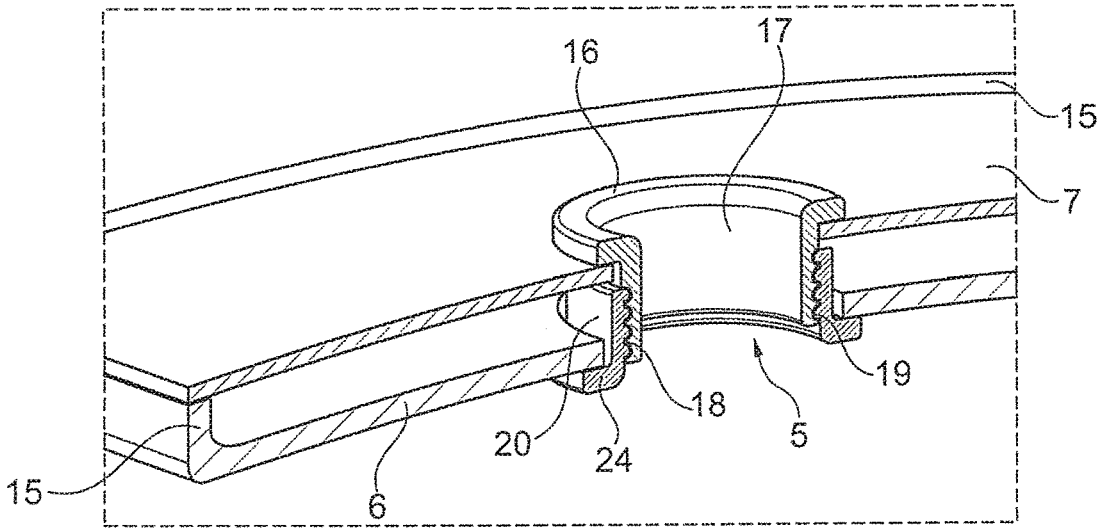

In the following, the invention is described based on exemplary embodiments in connection with the drawing. Herein:

FIG. 1 shows a schematic rendering of a gas turbine engine according to the present invention, FIG. 2 shows a longitudinal sectional view of a combustion chamber according to the state of the art, FIG. 3 shows a schematic sectional view of a first exemplary embodiment of the invention, in which the snap-in element is connected in one piece to the combustion chamber shingle, FIGS. 4 and 5 show perspective renderings of a combustion chamber shingle according to the exemplary embodiment of FIG. 3, and FIG. 6 shows a partial perspective sectional view of a further exemplary embodiment with a separate snap-in element.

The gas turbine engine 110 according to FIG. 1 represents a general example of a turbomachine in which the invention can be used. The engine 110 is configured in a conventional manner and comprises, arranged successively in flow direction, an air inlet 111, a fan 112 rotating inside a housing, a medium-pressure compressor 113, a high-pressure compressor 114, a combustion chamber 115, a high-pressure turbine 116, a medium-pressure turbine 117 and a low-pressure turbine 118, as well as an exhaust nozzle 119 with an outlet cone, which are all arranged around a central engine middle axis 101.

The medium-pressure compressor 113 and the high-pressure compressor 114 respectively comprise multiple stages, of which each has an arrangement of fixedly attached stationary guide vanes 120 extending in the circumferential direction, which are generally referred to as stator vanes and which protrude radially inwards from the engine shroud 121 through the compressors 113, 114 into a ring-shaped flow channel. Further, the compressors have an arrangement of compressor rotor blades 122, which protrude radially outwards from a rotatable drum or disc 125 and which are coupled to hubs 126 of the high-pressure turbine 116 or of the medium-pressure turbine 117.

The turbine sections 116, 117, 118 have similar stages, comprising an arrangement of stationary guide vanes 123, which protrude radially inwards from the housing 121 through the turbines 116, 117, 118 into the ring-shaped flow channel, and a subsequent arrangement of turbine blades 124 which protrude outwards from the rotatable hub 126. During operation, the compressor drum or compressor disc 125 and the blades 122 arranged thereon as well as the turbine rotor hub 126 and the turbine blades 124 arranged thereon rotate around the engine middle axis 101.

FIG. 2 shows an enlarged longitudinal sectional view of a combustion chamber wall as it is known from the state of the art. Here, the combustion chamber 1 is shown with a middle axis 9 which comprises a combustion chamber head 3, a base plate 8, and a heat shield 2. A burner seal is indicated with the reference sign 4. The combustion chamber 1 has an outer cold combustion chamber wall 7 to which an inner hot combustion chamber wall 6 is attached. Mixed air holes 5 are provided for the purpose of supplying mixed air. With a view to clarity, impingement cooling holes and effusion holes are not illustrated.

The inner combustion chamber wall 6 is provided with bolts 13 that are embodied as threaded bolts and that are screwed on by means of nuts 14. The combustion chamber 1 is mounted by means of combustion chamber flanges 12 and combustion chamber suspensions 11. Number 10 indicates the sealing lip.

FIG. 3 shows a schematic sectional view of a first exemplary embodiment of the invention. Here, a combustion chamber wall 7 is shown which forms an outer cold combustion chamber wall 7 and can also be referred to as a shingle support. The combustion chamber wall 7 is provided with a mixed air hole 5, with its central axis being identified by the number 21.

A shingle 6, which is provided with a circumferential shingle edge 15, is arranged at the hot side of the combustion chamber wall 7, as illustrated in FIGS. 4 and 5. In a manner analogous to the rendering of FIG. 6, the shingle edge 15 abuts the internal side of the combustion chamber wall 7 and thus forms an intermediate space 22 through which cooling air can be guided in a manner that is not shown here, in particular through impingement cooling holes that are not illustrated. Through effusion cooling holes (not shown) of the shingle 6, the cooling air from the intermediate space 22 is guided onto the hot surface of the shingle 6.

FIG. 3 shows that the shingle 6 is also provided with a mixed air hole which is delimitated by a tubular snap-in element 20. A ring flange 23 is provided at the hot side of the shingle, extending into the interior space of the combustion chamber 1.

At the internal side of the tubular snap-in element 20, second snap-in means 19 are configured which are snapped in with the first snap-in means 18 that are configured at a tubular fastening element 17. The tubular fastening element 17 has an outer ring flange 16, abutting with the same against the cold exterior side of the combustion chamber wall 7.

The snap-in means 18 and 19 can be configured in the form of sawtooth-like or trapezoid elevations and/or recesses, which extend in a ring-like manner around the circumference of the snap-in element 20 as well as of the tubular fastening element 17. By pressing the fastening element 17 into the snap-in element 20 the two elements are locked with each other. Since the shingle 6 abuts with its shingle edge 15 against the combustion chamber wall 7, a clearance is created between the snap-in element 20 and the combustion chamber wall 7. The height of the snap-in element 20 is thus lower than the height of the shingle edge 15. It is thus possible to carry out the mounting of the shingle 6 at the combustion chamber wall 7 by means of applying pre-stressing.

FIGS. 4 and 5 respectively show one shingle 6 in a perspective rendering in a view from the cold side (FIG. 4) and the hot side (FIG. 5). Here, in particular the tubular fastening element 17 with the ring flange 16 is clearly shown.

FIG. 6 shows a further exemplary embodiment in which the snap-in element 20 is configured as a separate structural component having a flange 24 by means of which the fastening element 20 is supported against the shingle 6 at the hot side thereof. Also in this exemplary embodiment, the snap-in element 20 has second snap-in means 19 that are snapped in with the first snap-in means 18 of the fastening element 17. As can also be seen in FIG. 6, the shingle edge 15 abuts the combustion chamber wall 7, while the height of the snap-in element 20 is lower than the height of the shingle edge 15, so that the snap-in element 20 does not touch the combustion chamber wall 7. In this manner, mounting by means of pre-stressing is facilitated.

PARTS LIST

1 combustion chamber
2 heat shield
3 combustion chamber head
4 burner seal
5 mixed air hole
6 shingle
7 combustion chamber wall
8 base plate
9 middle axis
10 sealing lip
11 combustion chamber suspension
12 combustion chamber flange
13 bolt
14 nut
15 shingle edge
16 ring flange
17 fastening element
18 first snap-in means
19 second snap-in means
20 snap-in element
21 middle axis
22 intermediate space
23 ring flange
24 flange
101 engine middle axis
110 gas turbine engine/core engine
111 air inlet
112 fan
113 medium-pressure compressor (compactor)
114 high-pressure compressor
115 combustion chamber
116 high-pressure turbine
117 medium-pressure turbine
118 low-pressure turbine
119 exhaust nozzle
120 guide vanes
121 engine shroud
122 compressor rotor blades
123 guide vanes
124 turbine blades/vanes
125 compressor drum or compressor disc
126 turbine rotor hub
127 outlet cone

The invention claimed is:

1. A gas turbine combustion chamber, comprising: a combustion chamber wall; a shingle that is fastened to the combustion chamber wall at a first distance from the combustion chamber wall to form an intermediate space between the shingle and the combustion chamber wall, wherein the shingle includes a shingle edge that abuts the combustion chamber wall, wherein the combustion chamber wall and the shingle respectively include a mixed air hole;

a tubular fastening element positioned through the mixed air hole of the combustion chamber wall, wherein the tubular fastening element includes a ring flange positioned on a side of the combustion chamber wall facing away from the shingle, wherein the tubular fastening element includes on a side thereof, a first snap-in device including a first extending portion and a first recessed portion adjacent one another in an axial direction of the tubular fastening element;

a tubular snap-in element engaging and holding the combustion chamber shingle to the combustion chamber wall, the tubular snap-in element including a second snap-in device including a second extending portion and a second recessed portion adjacent one another in an axial direction of the tubular snap-in element, the first extending portion and the second extending portion having respective dimensions to provide a snap connection between the first extending portion and the second extending portion, at least one chosen from the first snap-in device and the second snap-in device having sufficient flexibility such that the first extending portion can pass by the second extending portion upon application of a purely axial pressure between the tubular fastening element and the tubular snap-in element, the first snap-in device engaging the second snap-in device when pressed together such that:

the first extending portion is adjacent the second recessed portion and the first recessed portion is adjacent the second extending portion, the tubular snap-in element is locked to the tubular fastening element by the snap connection between the first extending portion and the second extending portion;

wherein the tubular snap-in element includes an extending portion that extends into the intermediate space at a second distance that is smaller than the first distance so that there is a first axial clearance provided between an end of the tubular snap-in element positioned in the intermediate space and a surface of the combustion chamber wall facing the intermediate space in an area immediately surrounding at least one chosen from the tubular fastening element and the tubular snap-in element; and wherein the first axial clearance and the locking between the tubular snap-in element and the tubular fastening element creates a pre-stress between the shingle and the combustion chamber wall at least in an area of the mixed air hole.

2. The gas turbine combustion chamber according to claim 1, wherein the tubular snap-in element is configured in one piece with the shingle.

3. The gas turbine combustion chamber according to claim 1, wherein the tubular snap-in element is configured as a separate structural component from the shingle.

4. The gas turbine combustion chamber according to claim 1, wherein the second snap-in device is positioned on an internal surface of the tubular snap-in element.

5. The gas turbine combustion chamber according to claim 1, wherein the first snap-in device is releasable with respect to the second snap-in device.

6. The gas turbine combustion chamber according to claim 1, wherein at least one chosen from the first extending portion and the second extending portion is configured as a ring and at least one chosen from the first recessed portion and the second recessed portion is configured as a groove.

* * * * *